US006925990B1

(12) United States Patent
Konopacki

(10) Patent No.: US 6,925,990 B1
(45) Date of Patent: Aug. 9, 2005

(54) METHOD FOR CONTROLLING FUEL PRESSURE FOR A FUEL INJECTED ENGINE

(75) Inventor: Jeffery M. Konopacki, Ripon, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/632,031

(22) Filed: Jul. 31, 2003

(51) Int. Cl.[7] ..... F02M 37/04
(52) U.S. Cl. ..... 123/497; 123/357
(58) Field of Search ..... 123/497, 499, 123/463, 494, 357, 358, 359

(56) References Cited

U.S. PATENT DOCUMENTS

| | | | | |
|---|---|---|---|---|
| 3,822,677 A | | 7/1974 | Reddy | 123/32 |
| 4,982,331 A | | 1/1991 | Miyazaki | 364/431 |
| 5,237,975 A | * | 8/1993 | Betki et al. | 123/497 |
| 5,398,655 A | | 3/1995 | Tuckey | 123/456 |
| 5,411,002 A | * | 5/1995 | Smitley | 123/497 |
| 5,718,207 A | * | 2/1998 | Ito | 123/497 |
| 5,762,048 A | * | 6/1998 | Yonekawa | 123/514 |
| 6,357,422 B1 | | 3/2002 | Doane et al. | 123/458 |
| 6,516,784 B1 | | 2/2003 | Shingu | 123/450 |

* cited by examiner

*Primary Examiner*—Mahmoud Gimie
(74) *Attorney, Agent, or Firm*—William D. Lanyi

(57) ABSTRACT

A fuel pressure control system for a fuel injected engine measures the fuel pressure at an outlet of a fuel pump and controls the operating speed of the fuel pump as a function of the difference between a desired pressure and a measured pressure. Signals are provided to the fuel pump which are pulse width modulated signals that have a pulse width determined as a function of the desired pressure at the outlet of the pump and an actual measured pressure at the outlet of the pump. The desired pressure is determined as a function of air flow into the engine, a desired air/fuel ratio which, in turn, is a function of engine speed and the load on the engine, and a desired fuel rate which is determined as a function of the air/fuel ratio and the air flow into the engine. The desired fuel rate is then used to select a pressure at the outlet of the pump which will result in the desired fuel rate.

8 Claims, 2 Drawing Sheets

METHOD FOR CONTROLLING FUEL PRESSURE FOR A FUEL INJECTED ENGINE

BACKGROUND OF THE INVENTION

1. Field of the Invention

The present invention is generally related to a pressure control method and, more particularly, to a method for controlling fuel pressure at a fuel injector by controlling the operational speed of a fuel pump.

2. Description of the Prior Art

U.S. Pat. No. 6,357,422, which issued to Doane et al on Mar. 19, 2002, describes a fuel pressure regulation system for use in a fuel pump system in which atomizing air is injected into the fuel delivered to the injector. The system includes both an air rail and a fuel rail and is operable to maintain the fuel pressure within the system at a consistent pressure above the air rail pressure. The system also includes a first pressure sensor, a second pressure sensor, a control circuit, and a fuel pressure pump or other fuel control device. The first and second pressure sensors are differential pressure sensors which measure the air and fuel pressure, respectively, convert those measurements into first and second electronic signals, and send those signals to the control circuit. The control circuit is an electronic circuit that includes a first stage, a second stage, and an output stage and provides the fuel pump with a closed loop control based on the first and second signals. Preferably, the closed loop control is achieved using both proportional and integral control with the output being in the form of a pulse-width modulated signal. The fuel pump is in fluid communication with the fuel rail and adjusts the fluid pressure within the fuel rail according to the pulse-width signal sent by the control circuit.

U.S. Pat. No. 3,822,677, which issued to Reddy on Jul. 9, 1974, describes an electric fuel pump control circuit for intermittent injection electronic fuel control systems. The circuit provides optimum fuel delivery at constant operating pressure to the fuel injector valve means of an electronically controlled fuel supply system. By energizing the pump in response to the engine operating parameters which determine the fuel requirement, a minimum of fuel in excess of the fuel requirement is recirculated from the area of the engine back to the fuel reservoir. In order to suitably energize the fuel pump, the pump is provided with a maximum voltage during the time period of the injection pulse with the energization voltage decreasing thereafter so that a minimum of fuel is circulated through the fuel supply system during the noninjection phase. This provides a variable level of average fuel pump energization.

U.S. Pat. No. 4,982,331, which issued to Miyazaki on Jan. 1, 1991, describes a fuel injector control apparatus. The apparatus is intended for a fuel injector and has a microcomputer which calculates a basic pulse width of pulses to be applied to a fuel injector. When the voltage of a battery which powers a fuel pump and the fuel temperature fall below levels which cause the discharge pressure of the fuel pump to drop below a prescribed pressure, the microcomputer corrects the basic pulse width by lengthening it to compensate for the drop in fuel pressure. Pulses having the corrected pulse width are applied to the fuel injector.

U.S. Pat. No. 6,516,784, which issued to Shingu on Feb. 11, 2003, describes a pressure accumulating distribution type of fuel injection pump. The pump is for a low pollution diesel engine which provides a low fuel economy and which can correspond to the regulation of exhaust emission. The pressure accumulating distribution type fuel injection pump is provided for supplying respective cylinders with fuel that is high-pressured and accumulated in pressure accumulation chambers through a distribution shaft. In the fuel injection pump, function members constituting a high-pressure path, such as a plunger, an injection control valve for fuel injection control, the pressure accumulation chambers, the distribution shaft or the like are arranged in a hydraulic base. One plunger portion is provided for pressure-supplying fuel to the pressure accumulation chambers.

U.S. Pat. No. 5,398,655, which issued to Tuckey on Mar. 21, 1995, describes a manifold referenced returnless fuel system. A fuel pressure regulator for a no-return fuel system for an automotive engine with fuel injectors is disclosed. It has a housing with a flexible diaphragm between first and second chambers. The second chamber has a fuel inlet receiving fuel from a fuel pump with a spring biased valve therein to admit fuel to the second chamber and an outlet to supply fuel to the engine. The second chamber is in continuous communication with the engine to accumulate any fuel expansion that may occur during engine deceleration or when the engine is turned off due to heating of the fuel. The first chamber continuously communicates with the engine air intake manifold so that fuel is supplied to the engine fuel injectors at a substantially constant pressure drop across the injectors. An over-pressure relief by-pass valve responsive to pressure at said fuel inlet will by-pass fuel to a reservoir when pressure in said second chamber opens said spring biased valve. A switch in the by-pass valve acts through a pulse width modulator to reflect the overpressure to the pump drive.

The patents described above are hereby expressly incorporated by reference in the description of the present invention.

In high Break Mean Effective Pressure (BMEP) fuel injected engines, injectors with very wide dynamic ranges are typically required. These injectors tend to be produced in low volumes and are relatively expensive in comparison to other types of less capable fuel injectors. One way to achieve a larger effective injector dynamic range is to supply a lower fuel pressure at lower engine power operating points and a higher pressure at higher engine power operating points. Another problem that is encountered in the typical constant pressure, mechanically regulated, fuel system is the excessive heat that is transferred to the fuel under low engine power conditions. The traditional system, known to those skilled in the art, employs a pump running at full capacity under all operating conditions. This dictates that under most engine operating conditions a greater than necessary amount of work is done to maintain the target pressure and this excessive work ultimately results in higher fuel temperatures.

It would therefore be significantly beneficial if less work is performed in pumping fuel to a fuel injector under operating conditions that do not require high fuel pressures.

SUMMARY OF THE INVENTION

A method for controlling fuel pressure for a fuel injected engine, made in accordance with the preferred embodiment of the present invention, comprises the steps of providing a fuel pump with an inlet port which is connectable in fluid communication with a fuel supply and an outlet port which is connectable in fluid communication with a fuel injector. It also comprises the step of measuring a fuel pressure at a location which is in fluid communication with the outlet port. In addition, the present invention comprises the step of controlling an operating speed of the fuel pump as a function of the fuel pressure measured at the location which is in fluid communication with the outlet port.

A preferred embodiment of the present invention further comprises the steps of measuring airflow into the fuel injected engine, calculating a desired fuel flow as a function of the selected air/fuel ratio, and determining the operating speed of the fuel pump as a function of the desired fuel flow.

In a preferred embodiment, the controlling step comprises the step of transmitting a pulse width modulated signal to the fuel pump. A duty cycle of the pulse width modulated signal determines the operating speed of the fuel pump.

The primary benefit of the present invention is achieved by controlling the operating speed of the fuel pump to suit the required pressure at an outlet of the pump. Rather than using a constant speed fuel pump and then regulating that pressure, the operating speed of the pump is determined in a way that achieves a desired output pressure from the pump without requiring a regulator. A controller provides a pulse width modulated signal to control the speed of the fuel pump as a function of the output speed at the outlet of the pump.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
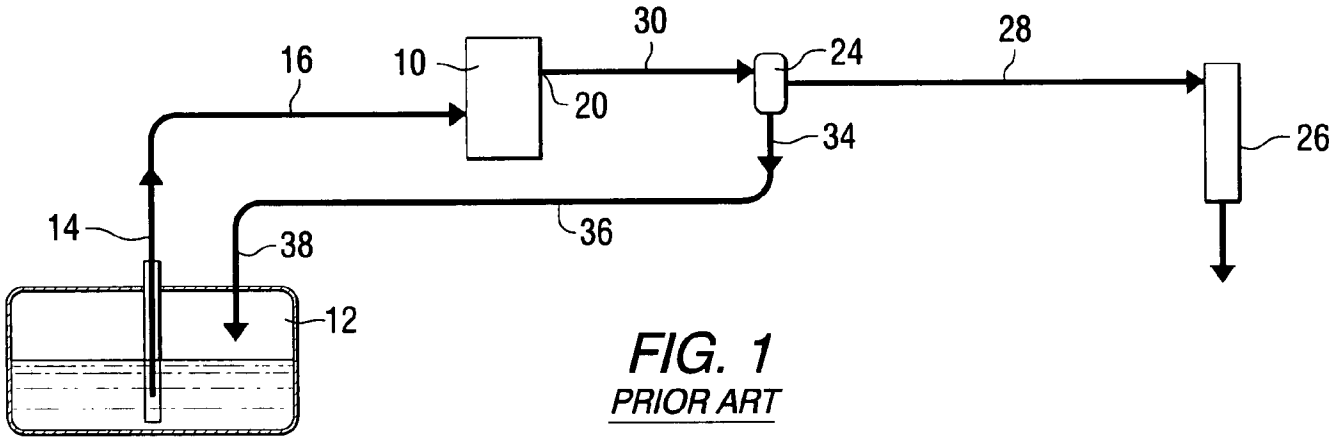
FIG. 1 PRIOR ART
FIG. 1 is a simplified schematic of a pressure control system known to those skilled in the art.

Throughout the description of the preferred embodiment of the present invention, like components will be identified by like reference numerals.

FIG. 1 shows a fuel pressure control system that is generally known to those skilled in the art. A fuel pump 10 draws fuel from a fuel reservoir 12 along a path identified by reference numerals 14 and 16. The fuel pump 10 provides fuel at its outlet 20 which is at a pressure equivalent to the maximum pressure which the pump 10 is capable of providing according to the configuration and circumstances in which the fuel pump 10 is used. A regulator 24 determines the operating pressure provided to a fuel injector 26. The pressure of the fuel provided to the fuel injector 26, as represented by arrow 28, is the pressure determined by the regulator 24. If the pressure in line 30, provided at the outlet 20 of the pump 10, is greater than the prescribed setting of the pressure regulator 24, excess fuel is returned to the reservoir 12 as indicated by arrows 34, 36, and 38. In certain circumstances, such as when the associated engine does not require the full capacity of the pump 10 to be injected through the injector 26, a significant amount of fuel is recirculated by the regulator 24 to the fuel reservoir 12. This recirculation of fuel results in an elevated temperature of fuel because of the amount of work performed on the liquid fuel by the pump 10. It should be understood that a typical fuel supply system for an injector 26 operates a pump 10 at its maximum capacity at all times, regardless of the fuel requirements of the engine. As a result, when full capacity is not required by the engine, excess fuel is recirculated by the regulator 24 to the reservoir 12 as indicated by arrows 34, 36, and 38.

Figure 2:
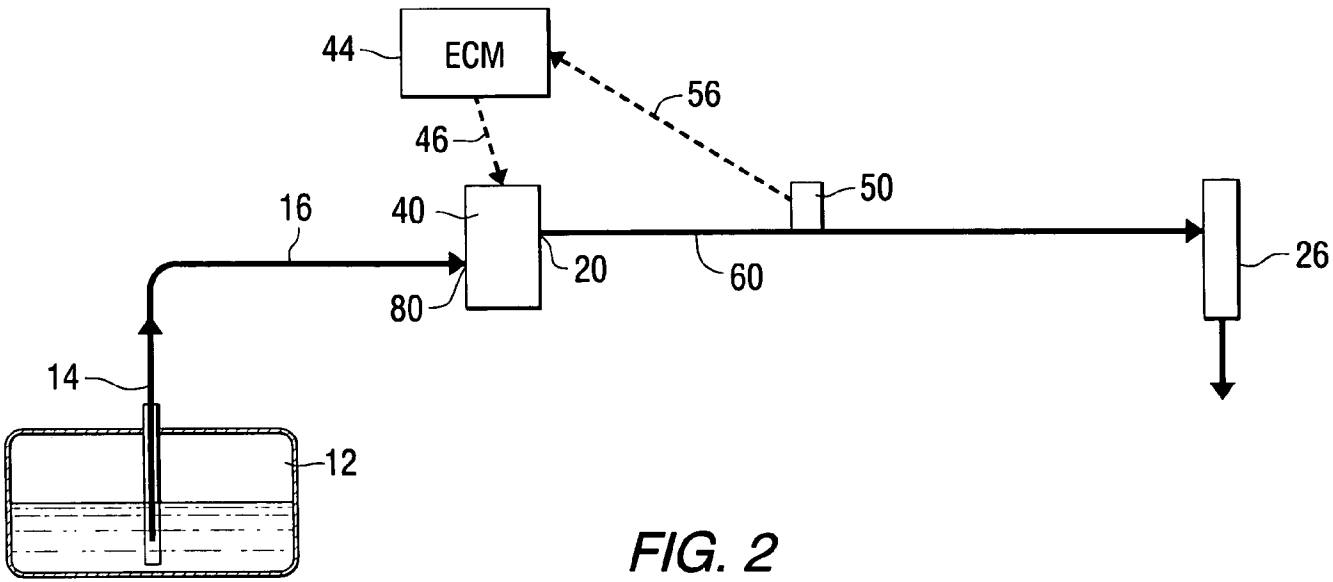
FIG. 2 is a simplified schematic of the present invention.

FIG. 2 is a simplified schematic representation of the present invention. A fuel pump 40 receives signals from an engine control module 44 which determines the operating speed of the pump 40. Dashed line 46 represents pulse width modulated signals provided from the engine control module (ECM) 44 to the pump 40. A pressure sensor 50 is connected in fluid communication with the outlet 20 of the pump 40 to measure the fuel pressure being provided by the pump 40 to the fuel injector 26. The engine control module 44 determines the pulse width modulated signal 46 as a function of a pressure signal 56 received from the pressure sensor 50. If the pressure in line 60 falls below a predetermined desired range, increased speed of the fuel pump 40 is demanded by an increased pulse width modulated signal 46. If the pressure at the injector 26 is too high, the signal 46 is modified to operate the pump 40 at a slower speed.

With continued reference to FIG. 2, the engine control module 44 controls the speed of the pump 40 as a function of the pressure in line 60 determined by the pressure sensor 50. As a result, a constant pressure can be maintained at the outlet port 20 of the pump 40 and the fuel injector 26 can be provided with a relatively constant and appropriate fuel pressure at all engine speeds.

Figure 3:
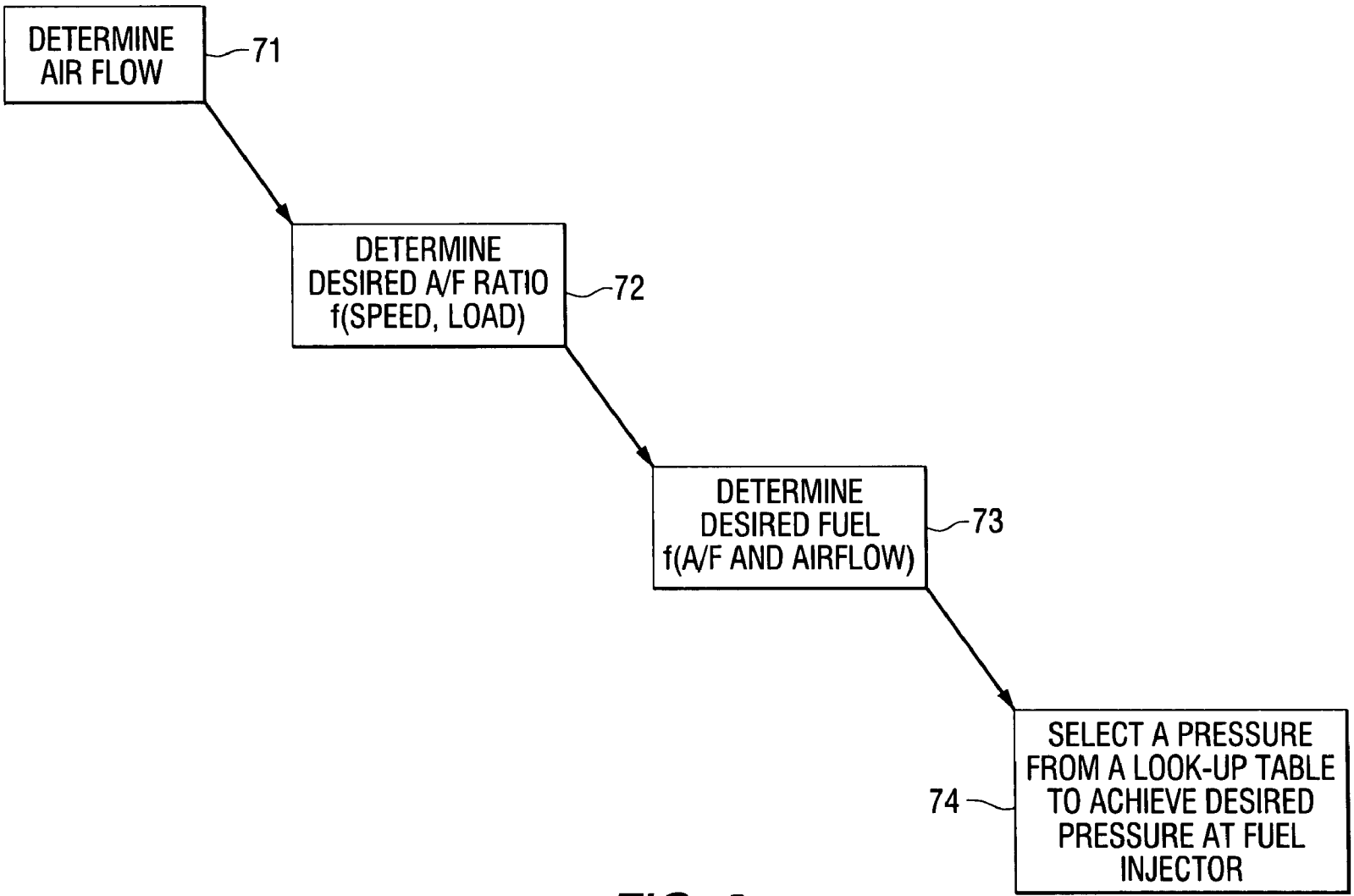
FIG. 3 is a flowchart showing the functional steps performed in one embodiment of the present invention.

FIG. 3 is an illustration showing the steps used to determine the desired pressure in line 60 of FIG. 2. It should be understood that the chart in FIG. 3 is highly simplified for the purpose of describing the basic functions of the present invention. At functional block 71, the air flow passing through the intake manifold of an engine is determined. This can be measured either with a mass air flow sensor or by using relative pressures and temperatures to calculate the flow. As shown in functional block 72, a desired air/fuel ratio is selected as a function of the speed and load of an operating engine. These techniques are well known to those skilled in the art and will not be described in detail herein. A desired fuel rate is determined, as represented at functional block 73, as a function of the air/fuel ratio and the air flow. This step is also well known to those skilled in the art. Once the desired fuel rate is determined at functional block 73, it is used to determine a desired pressure at the outlet 20 of the fuel pump 40 and the inlet of the fuel injector 26. This can be done by using a lookup table that stores appropriate pressures as a function of determined fuel rates. This selection is shown at functional block 74.

With reference to FIGS. 1–3, it can be seen that the present invention provides a method for controlling fuel pressure for a fuel injected engine which comprises the steps of providing a fuel pump 40 with an inlet port 80 that is connectable in fluid communication with a fuel supply, or reservoir 12, and an outlet port 20 which is connectable in fluid communication with a fuel injector 26. It further comprises the step of measuring a fuel pressure, with a pressure sensor 50, at a location which is in fluid communication with the outlet port 20, such as line 60 in FIG. 2. An additional step of the present invention is controlling the operating speed of the fuel pump 40 as a function of the fuel pressure measured at the location which is in fluid communication with the outlet port 20 by pressure sensor 50.

It should be understood that the system shown in FIG. 2 is incorporated as part of a fuel injected engine. The operation of a fuel injected engine is well known to those skilled in the art and will not be described in detail herein. The method of the present invention can be performed by a system such as that shown in FIG. 2. As a result, the pressure in line 60 can be accurately maintained so that the required pressure of fuel provided to the injector 26 is continuously and accurately provided. The desired pressure in line 60, as described above in conjunction with FIG. 3, is determined as a function of air flow, engine speed, the load on the engine, the desired air/fuel ratio, and the determined fuel rate which is used to select a desired pressure at the fuel injector 26 that will achieve the fuel rate determined and calculated by functional steps 71–73 in FIG. 3.

Although the present invention has been described in particular detail and illustrated to show a preferred embodiment, it should be understood that alternative embodiments are also within its scope.

I claim:

1. A method for controlling fuel pressure for a fuel injected engine, comprising the steps of:

providing a fuel pump with an inlet port which is connectable in fluid communication with a fuel supply and an outlet port which is connectable in fluid communication with a fuel injector;

measuring a fuel pressure at a location which is in fluid communication with said outlet port;

controlling an operating speed of said fuel pump as a function of said fuel pressure measured at said location which is in fluid communication with said outlet port;

measuring airflow into said fuel injected engine;

calculating a desired fuel flow as a function of a selected air/fuel ratio; and determining said operating speed of said fuel pump as a function of said desired fuel flow.

2. The method of claim 1, wherein:

said controlling step comprises the step of transmitting a pulse width modulated signal to said fuel pump.

3. The method of claim 2, wherein:

a duty cycle of said pulse width modulated signal determines said operating speed of said fuel pump.

4. A fuel pressure control system for a fuel injected engine, comprising:

a fuel pump with an inlet port which is connectable in fluid communication with a fuel supply and an outlet port which is connectable in fluid communication with a fuel injector;

a fuel pressure sensor disposed at a location which is in fluid communication with said outlet port;

a controller connected in signal communication with said fuel pressure sensor and in signal communication with said fuel pump, said controller being configured to provide a signal to control an operating speed of said fuel pump as a function of a signal received from said pressure sensor; and an airflow sensor for measuring a rate of air flowing into said engine, said controller being configured to determine a desired fuel flow rate as a function of said rate of air flowing into said engine and a selected air/fuel ratio, said operating speed of said fuel pump being determined as a function of said desired fuel flow rate.

5. The system of claim 4, wherein:

said controller is configured to transmit a pulse width modulated signal to said fuel pump which is representative of said operating speed.

6. The system of claim 5, wherein:

a duty cycle of said pulse width modulated signal determines said operating speed of said fuel pump.

7. A method for controlling fuel pressure for a fuel injected engine, comprising the steps of:

providing a fuel pump with an inlet port which is connectable in fluid communication with a fuel supply and an outlet port which is connectable in fluid communication with a fuel injector;

measuring a fuel pressure at a location which is in fluid communication with said outlet port; and controlling an operating speed of said fuel pump as a function of said fuel pressure measured at said location which is in fluid communication with said outlet port, said controlling step comprising the step of transmitting a pulse width modulated signal to said fuel pump, a duty cycle of said pulse width modulated signal determining said operating speed of said fuel pump.

8. The method of claim 7, further comprising:

measuring airflow into said fuel injected engine;

calculating a desired fuel flow as a function of a selected air/fuel ratio; and determining said operating speed of said fuel pump as a function of said desired fuel flow.

* * * * *

US006925990C1

(12) EX PARTE REEXAMINATION CERTIFICATE (6938th)

United States Patent

Konopacki

(10) Number: US 6,925,990 C1

(45) Certificate Issued: Jul. 14, 2009

(54) METHOD FOR CONTROLLING FUEL PRESSURE FOR A FUEL INJECTED ENGINE

(75) Inventor: Jeffery M. Konopacki, Ripon, WI (US)

(73) Assignee: Brunswick Corporation, Fond Du Lac, WI (US)

Reexamination Request:
No. 90/010,051, Nov. 8, 2007

Reexamination Certificate for:

| | |
|---|---|
| Patent No.: | **6,925,990** |
| Issued: | **Aug. 9, 2005** |
| Appl. No.: | **10/632,031** |
| Filed: | **Jul. 31, 2003** |

(51) Int. Cl.
*F02M 37/04* (2006.01)

(52) U.S. Cl. ..... 123/497; 123/357

(58) Field of Classification Search ..... None
See application file for complete search history.

(56) References Cited

U.S. PATENT DOCUMENTS

| | | | |
|---|---|---|---|
| 4,371,819 | A | 2/1983 | Kaufmann |
| 4,728,264 | A | 3/1988 | Tuckey |
| 4,756,291 | A | 7/1988 | Cummins et al. |
| 5,406,922 | A | 4/1995 | Tuckey |
| 5,699,772 | A | 12/1997 | Yonekawa et al. |

OTHER PUBLICATIONS

Michael Barr, "Introduction to Pulse Width Modulation", *Embedded Systems Programming,* vol. 14, No. 10, Aug. 31, 2001.

*Primary Examiner*—Joseph A. Kaufman

(57) ABSTRACT

A fuel pressure control system for a fuel injected engine measures the fuel pressure at an outlet of a fuel pump and controls the operating speed of the fuel pump as a function of the difference between a desired pressure and a measured pressure. Signals are provided to the fuel pump which are pulse width modulated signals that have a pulse width determined as a function of the desired pressure at the outlet of the pump and an actual measured pressure at the outlet of the pump. The desired pressure is determined as a function of air flow into the engine, a desired air/fuel ratio which, in turn, is a function of engine speed and the load on the engine, and a desired fuel rate which is determined as a function of the air/fuel ratio and the air flow into the engine. The desired fuel rate is then used to select a pressure at the outlet of the pump which will result in the desired fuel rate.

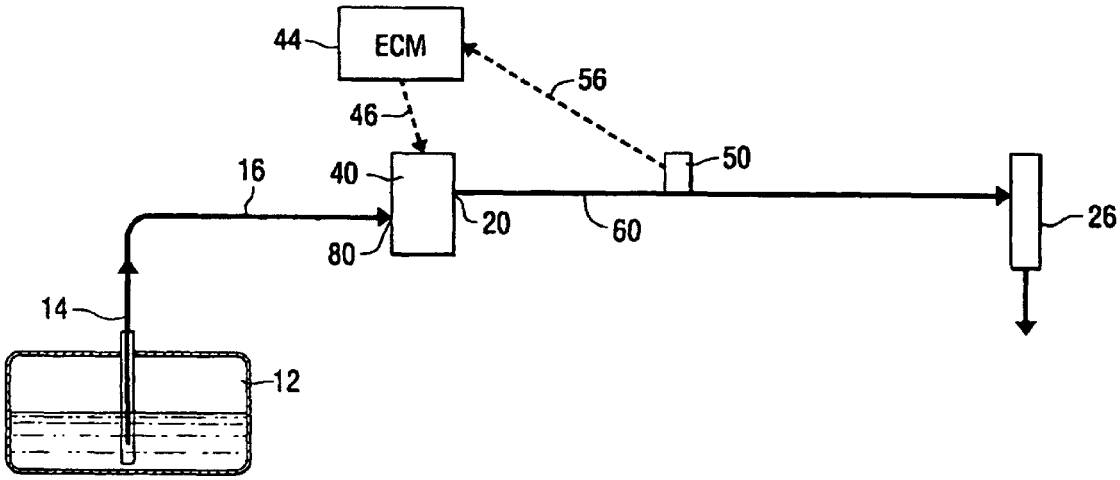

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1, 4 and 7 are cancelled.

Claims 2, 3, 5, 6 and 8 were not reexamined.

* * * * *